US006685338B1

(12) United States Patent
Lewis et al.

(10) Patent No.: US 6,685,338 B1
(45) Date of Patent: Feb. 3, 2004

(54) FLASHING COIN

(75) Inventors: Edward D. Lewis, Brownsburg, IN (US); Daniel J. Deutsch, Orlando, FL (US); Raymond W. Leung, Fremont, CA (US)

(73) Assignee: Buztronics, Inc., Indianapolis, IN (US)

( * ) Notice: Subject to any disclaimer, the term of this patent is extended or adjusted under 35 U.S.C. 154(b) by 0 days.

(21) Appl. No.: 10/099,206

(22) Filed: Mar. 15, 2002

Related U.S. Application Data

(60) Provisional application No. 60/358,186, filed on Feb. 20, 2002.

(51) Int. Cl.[7] ..... F21V 33/00

(52) U.S. Cl. ..... 362/234; 362/103; 362/116; 362/253; 362/276; 362/800

(58) Field of Search ..... 362/109, 116, 362/103, 234, 253, 276, 800, 802, 806; 40/27.5, 323

(56) References Cited

U.S. PATENT DOCUMENTS

| | | | | |
|---|---|---|---|---|
| 4,472,627 A | | 9/1984 | Weinberger | |
| 4,621,190 A | | 11/1986 | Saito et al. | |
| 4,674,618 A | | 6/1987 | Eglise et al. | |
| 4,692,846 A | * | 9/1987 | Johnson | 362/800 |
| 4,969,549 A | | 11/1990 | Eglise | |
| 5,197,741 A | | 3/1993 | Wu | |
| 5,789,733 A | | 8/1998 | Jachimowicz et al. | |
| 5,974,504 A | | 10/1999 | Lee et al. | |
| 6,419,384 B1 | | 7/2002 | Lewis et al. | |
| 2002/0108280 A1 | * | 8/2002 | Fernandez | 40/323 |

* cited by examiner

*Primary Examiner*—Stephen Husar
(74) *Attorney, Agent, or Firm*—William F. Bahret

(57) ABSTRACT

A completely self-contained, battery-powered flashing coin having a series of three visible-spectrum LEDs flashed in sequence when a flash control IC is triggered by a sufficient force, e.g., the force generated upon impact of the coin on one of its faces or sides from a height of about 50 mm. A cantilever switch contact suspended over a stationary contact on a circuit board closes in response to the sufficient force and triggers the IC. The coin is preferably provided with a decorative design and the LEDs are preferably arranged within or around the design so as to draw attention thereto during flashing action.

22 Claims, 3 Drawing Sheets

FLASHING COIN

CROSS-REFERENCE TO RELATED APPLICATION

This application claims the benefit of U.S. Provisional Patent Application Ser. No. 60/358,186, filed Feb. 20, 2002.

BACKGROUND OF THE INVENTION

This invention relates to simulated coins and, more particularly, to coins designed as commemorative pieces or play money or otherwise designed for entertainment, ornamental or promotional purposes.

SUMMARY OF THE INVENTION

The present invention provides a flashing coin comprising a hollow disc having parallel first and second generally circular plates joined by a rim, at least one plate having a surface bearing an image and including means for allowing light transmission through the image, and an impact-responsive, sequential flasher circuit contained within the disc, the circuit including a timer having a trigger input and a plurality of outputs, a DC power source operatively connected to the timer, an inertial switch connected to the trigger input of the timer, and a plurality of visible-light emitting elements connected to respective outputs of the timer, the light emitting elements being optically coupled to the means for allowing light transmission through the image.

DETAILED DESCRIPTION OF PREFERRED EMBODIMENTS

Figure 1:
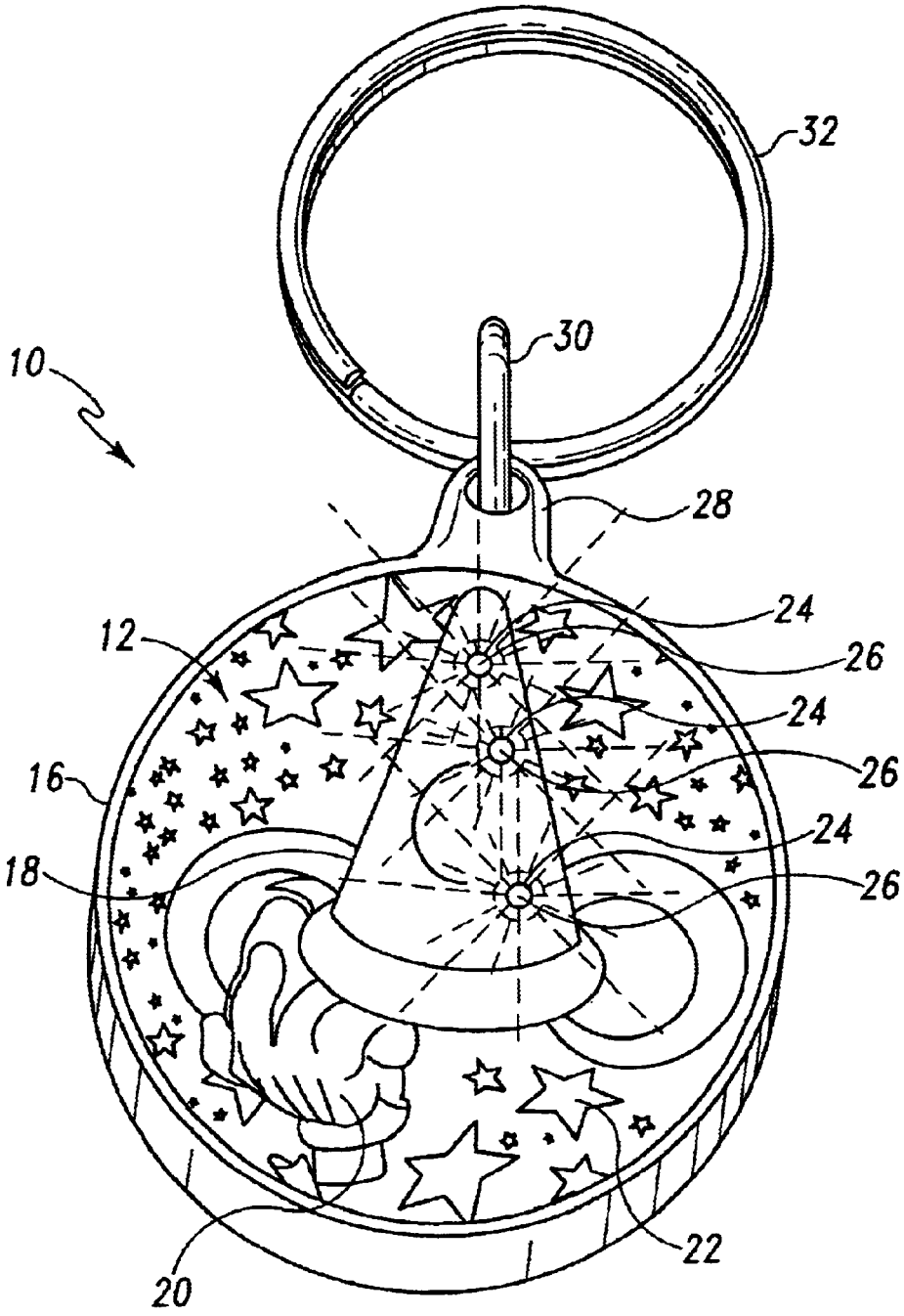
FIG. 1 is a perspective view of one embodiment of a flashing coin according to the present invention.

For the purpose of promoting an understanding of the principles of the invention, reference will now be made to the embodiments illustrated in the drawings and specific language will be used to describe the same. It will nevertheless be understood that no limitation of the scope of the invention is thereby intended, such alterations and further modifications in the illustrated device and such further applications of the principles of the invention as illustrated therein being contemplated as would normally occur to one skilled in the art to which the invention relates.

A perspective view of one embodiment of a flashing coin according to the present invention is illustrated in FIG. 1. The coin includes a disc-shaped case having two parallel plates or faces 12 and 14, one of which is visible in the drawing, and a raised rim 16 joining the two plates, both of which are preferably formed with raised images on their outer surfaces, e.g., a wizard's hat 18 and hand 20 along with a cluster of stars 22 on plate 12 as shown in the drawing. The case may be made of bronze or brass, and may be plated. A plurality of holes 24 in the face of the coin act as a means for allowing light transmission through the image on the face of the coin from an internal plurality of visible-light emitting elements 26 (i.e., elements emitting light of wavelength in the range of 0.4 to 0.7 $\mu$m), preferably LEDs, which are mounted such that their lenses extend at least partially into the respective holes 24. Alternatively, windows of transparent or translucent material may be provided in the case to allow light transmission therethrough. Such windows may be formed of a very thin portion of the case material itself or may be formed of some different material which covers or fills holes 24, and in such cases the case may be hermetically sealed. The coin may be adapted for use as a keychain ornament as shown in FIG. 1, e.g., with an eyelet 28 for a ring 30 which is in turn connected to a key ring 32.

Figure 2:
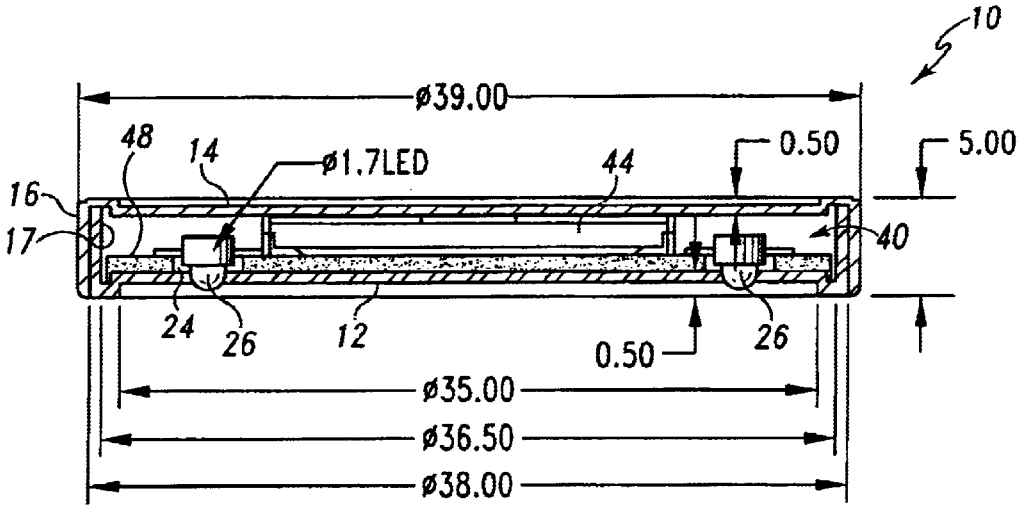
FIG. 2 is a cross-section of an embodiment of a flashing coin according to the present invention.
Figure 3:
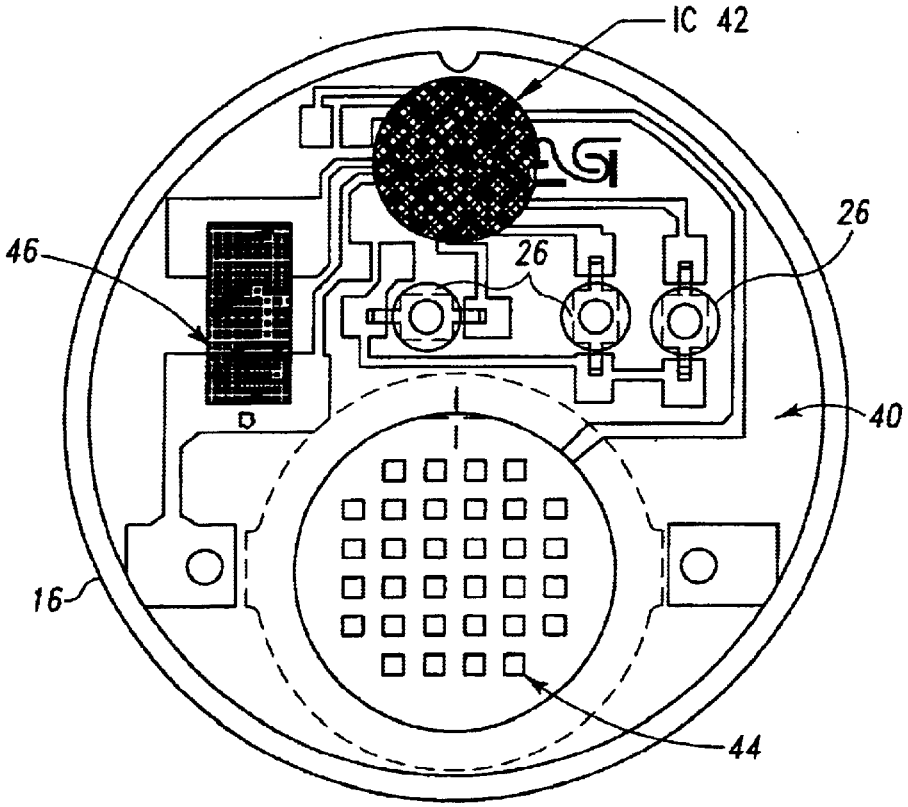
FIG. 3 is a top view of a flasher circuit in position in one half of the case of a coin according to the present invention.
Figure 4:
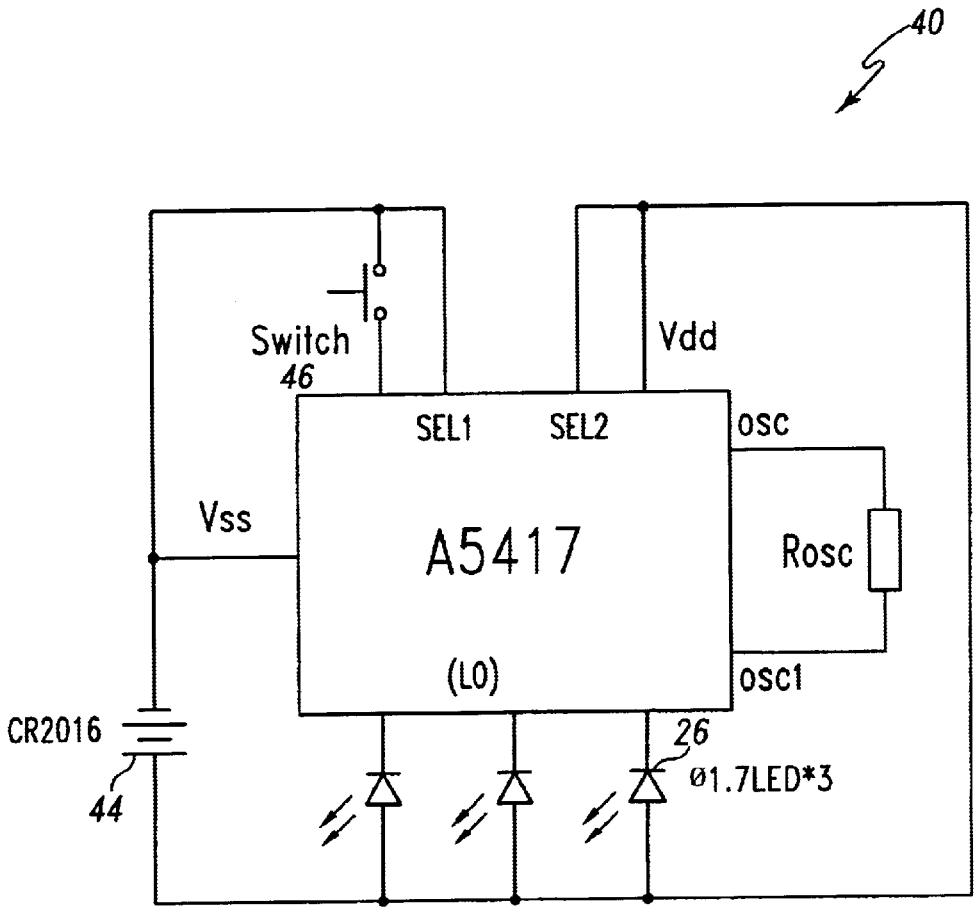
FIG. 4 is an electrical schematic of the flasher circuit of FIG. 3.

Referring to FIGS. 2 and 3, the coin contains an impact-responsive flasher circuit 40 which in the disclosed embodiment includes three LEDs 26 driven by an integrated circuit timer 42 which is powered by a single CR2016 3V lithium coin or button cell 44 and triggered by an inertial switch 46, all mounted on a printed circuit (pc) board 48. The LEDs may be X6361 1.5 mm clear red axial-lead LEDs from American Bright Optoelectronics Corp., Brea, Calif. FIG. 4 is a schematic of the circuit for the disclosed embodiment.

IC 42 may be a type A5417 flash driver, in die form, from Hua Ko Electronics Co., Ltd., Hong Kong. The IC is preferably configured to energize the three LEDs sequentially and to operate in one-shot mode, whereby the three LEDs are caused to flash in sequence a predetermined number of times in response to a single trigger input from switch 46. The IC is configured to provide a ⅓ duty cycle for each LED, e.g., an ON time of approximately 40 msec. and an OFF time of approximately 80 msec. for each LED, with a total cycle length of approximately 12 seconds. The IC is also configured in one embodiment to operate in true one-shot mode, i.e., as a non-retriggerable one-shot, whereby, once triggered, the one-shot is not retriggered by an input from switch 46 and times out at the end of the total timing cycle. Retriggerable one-shot operation is also contemplated, as are alternative timing intervals and duty cycles. It will of course be understood that the flash rate is a function of the value of resistor $R_{osc}$ connected to the A5417 IC as indicated in FIG. 4.

Switch 46 is suitably a cantilever switch having a flat metal cantilever arm, e.g., of stainless steel or copper, approximately 5 mm wide×9 mm long and approximately 0.1–0.2 mm thick, the arm being soldered or riveted on one end to the pc board such that the arm lies nearly parallel to the board surface with a gap of approximately 0.5 mm between the free end of the arm and a stationary switch contact provided on the pc board surface for contact with the free end of the arm upon deflection thereof in response to force applied perpendicular to the board surface. It will be appreciated that the switch is more sensitive to force applied perpendicular to the faces of the coin than to force applied parallel to the coin faces, and also more sensitive to force applied to the face of the coin that is closer to the stationary switch contact than to the free end of the cantilever arm. The combination of the gap and the thickness of the cantilever arm is preferably such that the switch closes when the coin is dropped, with its more sensitive side down, onto a hard surface from a height of approximately 50 mm. A switch meeting these specifications is available from Kai Tat Metal Factory, Hong Kong, as part number K2001-67. For some applications, a switch of this type with a smaller gap, e.g., in the range of 0.1–0.4 mm, may be suitable.

As shown in FIG. 2, in which one example set of dimensions is given in millimeters, one of the plates of the coin and the raised rim 16 may be of unitary, or one-piece construction. In the disclosed embodiment, plates 12 and 14 are stamped, pressed or otherwise formed with rim or flange portions 16 and 17 which mate with each other as illustrated in the drawing. The two plates may be stamped or otherwise formed separately as two halves of the coin case with a desired image on each half, and then, with the circuit board placed between them, the two halves may be rolled together and their edges pressed inwardly to form the rim or flange portions. Preferably, plate 14 is initially slightly larger in diameter than plate 12, and the outer rim 16 is pressed parallel to rim 17 and further pressed radially inwardly such that it partially encloses and thereby captures rim 17 and thereby holds the two plates securely together. During the process or as a separate step, rim 16 is marked with reeding or corrugations as on the edge of a conventional U.S. dime or quarter.

While the invention has been illustrated and described in detail in the drawings and foregoing description, the same is to be considered as illustrative and not restrictive in character, it being understood that only the preferred embodiment has been shown and described and that all changes and modifications that come within the spirit of the invention are desired to be protected. For example, an inertial switch in the form of a coil spring may be suitable in certain embodiments, with the coil spring suspended over a stationary contact on the circuit board as with the embodiment described above. An example of such a coil spring switch is disclosed in copending patent application Ser. No. 09/534,797, filed Mar. 24, 2000, now U.S. Pat. No. 6,419,384, which application is hereby incorporated by reference. It is also contemplated that the coin case may be made of plastic or other materials and may be provided with a decorative design in relief or in a single plane, such as an image of an animate or inanimate object, particularly including an image of a person, animal, or fictional character, and that the LEDs may be arranged within or around the design so as to draw attention thereto during flashing action.

We claim:

1. A flashing coin, comprising:

a hollow disc having parallel first and second generally circular plates and a rim joining said plates, at least one of said plates having a surface bearing an image and including means for allowing light transmission through said image; and an impact-responsive, sequential flasher circuit contained within said disc, said circuit including a timer having a trigger input and a plurality of outputs, a DC power source operatively connected to said timer, an inertial switch connected to said trigger input of said timer, and a plurality of visible-light emitting elements connected to respective outputs of said timer, said light emitting elements being optically coupled to said means for allowing light transmission through said image.

2. The flashing coin of claim 1, wherein said light emitting elements are LEDs and wherein said timer energizes said LEDs in sequence for an ON time interval of approximately 10–100 msec. each.

3. The flashing coin of claim 2, wherein said time interval is approximately 40 msec. and wherein said LEDs are off for a time interval exceeding said ON time interval.

4. The flashing coin of claim 3, wherein said inertial switch is a cantilever switch having a cantilever arm extending parallel to said plates.

5. The flashing coin of claim 4, wherein said coin has a maximum thickness of less than 10 mm.

6. The flashing coin of claim 1, wherein said coin has a maximum thickness of less than 10 mm.

7. A flashing coin, comprising:

a hollow disc having parallel first and second generally circular plates and a rim joining said plates, at least one of said plates having a surface bearing an image and including a hole through said surface; and an impact-responsive flasher circuit contained within said disc, said circuit including a timer having a trigger input and an output, a battery operatively connected to said timer, an inertial switch connected to said trigger input of said timer, and a visible-light emitting element connected to said output of said timer and extending at least partially through said hole in said surface.

8. The flashing coin of claim 7, wherein said light emitting element is an LED and wherein said timer energizes said LED for an ON time interval of approximately 10–100 msec.

9. The flashing coin of claim 8, wherein said time interval is approximately 40 msec. and wherein said LED is off for a time interval of approximately 80 msec.

10. The flashing coin of claim 9, wherein said inertial switch is a cantilever switch having a cantilever arm extending parallel to said plates.

11. The flashing coin of claim 10, wherein said coin has a maximum thickness of less than 10 mm.

12. The flashing coin of claim 7, wherein said coin has a maximum thickness of less than 10 mm.

13. The flashing coin of claim 12, wherein said intertial switch is a cantilever switch having a cantilever arm extending parallel to said plates.

14. The flashing coin of claim 7, wherein said intertial switch is a cantilever switch having a cantilever arm extending parallel to said plates.

15. The flashing coin of claim 7, wherein said timer has a plurality of outputs, and wherein said flasher circuit includes a plurality of visible-light emitting elements connected to respective outputs of said timer.

16. A flashing coin, comprising:

a hollow disc having parallel first and second generally circular plates and a rim joining said plates, at least one of said plates having a surface bearing an image and including means for allowing light transmission through said image; and an impact-responsive flasher circuit contained within said disc, said circuit including a timer having a trigger input and output, a DC power source operatively connected to said timer, an interial switch connected to said trigger input of said timer, and a visible-light emitting element connected to said output of said timer, said light emitting element being optically coupled to said means for allowing light transmission through said image.

17. The flashing coin of claim 16, wherein said light emitting element is an LED and wherein said timer energizes said LED for an ON time interval of approximately 10–100 msec.

18. The flashing coin of claim 17, wherein said time interval is approximately 40 msec. and wherein said LED is off for a time interval exceeding said ON time interval.

19. The flashing coin of claim 16, wherein said inertial switch is a cantilever switch having a cantilever arm extending parallel to said plates.

20. The flashing coin of claim 19, wherein said coin has a maximum thickness of less than 10 mm.

21. The flashing coin of claim 16, wherein said coin has a maximum thickness of less than 10 mm.

22. The flashing coin of claim 16, wherein said means for allowing light transmission through said image comprises light-transmitting material.

* * * * *